United States Patent [19]

Carstensen et al.

[11] 4,215,602

[45] Aug. 5, 1980

[54] POWER TONGS

[75] Inventors: Kenneth J. Carstensen; John J. Staudt, III, both of Odessa, Tex.

[73] Assignee: Bob's Casing Crews, Odessa, Tex.

[21] Appl. No.: 919,365

[22] Filed: Jun. 26, 1978

[51] Int. Cl.[2] ..... B25B 17/00

[52] U.S. Cl. ..... 81/57.18; 81/57.21

[58] Field of Search ..... 81/57.11–57.21; 173/2

[56] References Cited

U.S. PATENT DOCUMENTS

| | | | |
|---|---|---|---|
| 2,668,689 | 2/1954 | Cormany | 81/57.16 |
| 2,809,472 | 10/1957 | Happel | 51/237 CS |
| 2,846,909 | 8/1958 | Mason | 81/57.18 |
| 2,989,880 | 6/1961 | Hesser et al. | 81/57.18 |
| 3,023,651 | 3/1962 | Wallace | 81/57.2 |
| 3,541,897 | 11/1970 | Horton | 81/57.18 |
| 3,646,710 | 3/1972 | Flohr | 51/237 CS |
| 4,084,453 | 4/1978 | Eckel | 81/57.18 |
| 4,095,493 | 6/1978 | Haynes | 81/57.18 |

*Primary Examiner*—James L. Jones, Jr.
*Attorney, Agent, or Firm*—Fraser and Bogucki

[57] ABSTRACT

A power tong system for engaging or disengaging threaded pipe sections has an annular rotary member that is supported against lateral thrust and include a hinged portion that is pivotable to permit side access to a pipe. The rotary member is rotated about its central axis by a peripheral drive chain engaging the rotary member through a relatively small wrap angle. The free end of the hinged portion and the opposing end of the principal body of the rotary interlock and become more secure in self-centering fashion under the spreading forces that are exerted during operation. An interlock and latching system insure against erroneous sequencing and operation without full closure of the hinged mechanisms. Structurally rigid head plates on opposite sides of the rotary member are slidable relative to the housing, and incorporate spaced apart radial bearing slots that guide oppositely disposed heads that engage the pipe with hardened die elements. Twisting moments on the heads are absorbed in the head plates, such that the heads are subjected only to uniform and symmetrical forces. Balanced radial and rotational forces are applied to the pipe in both the engage and disengage directions without a need for frictional restraint or braking force on any member. The system operates smoothly and quietly, can generate extremely high torques and has very long die life.

46 Claims, 14 Drawing Figures

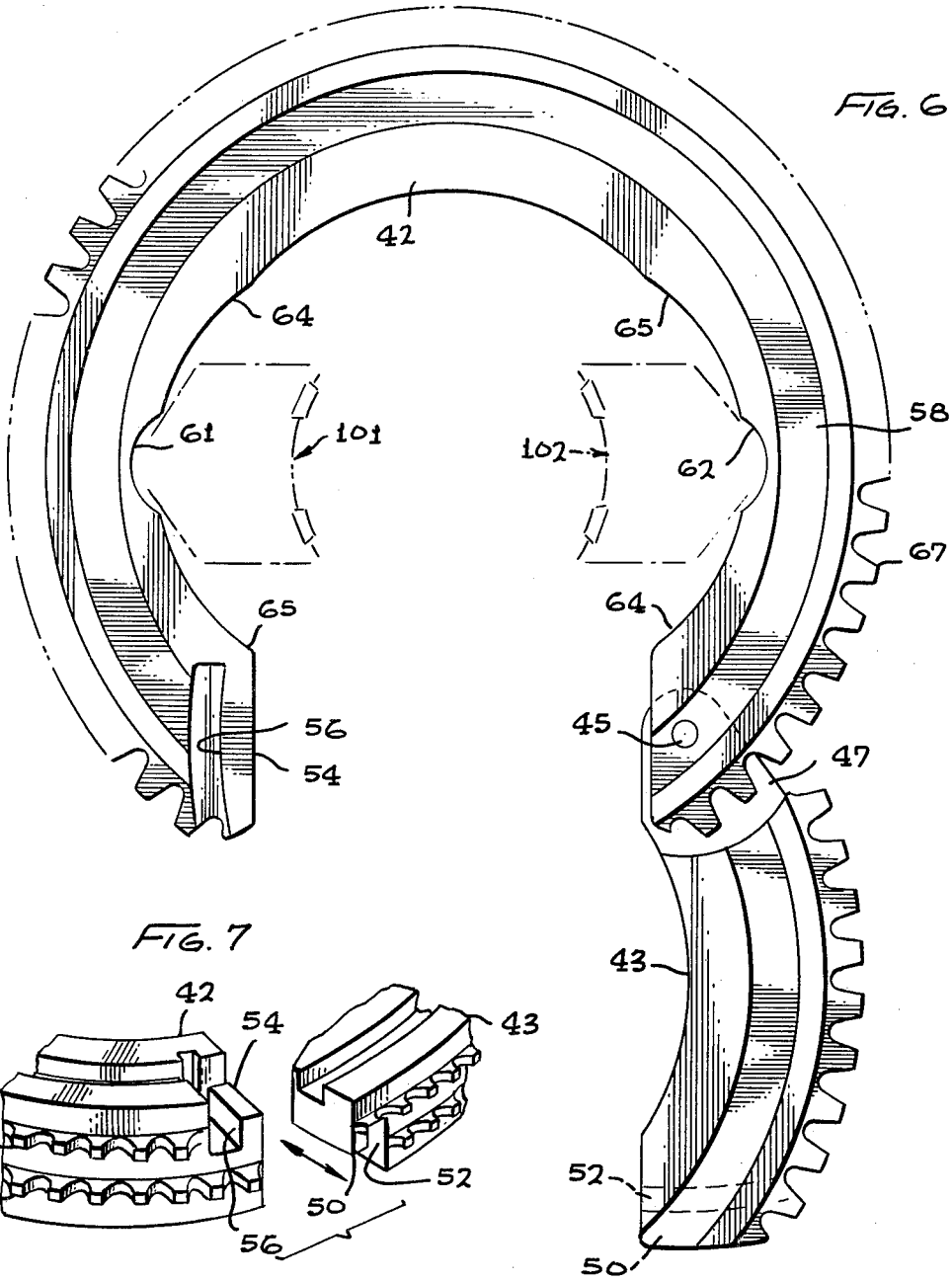
FIG. 6
FIG. 7
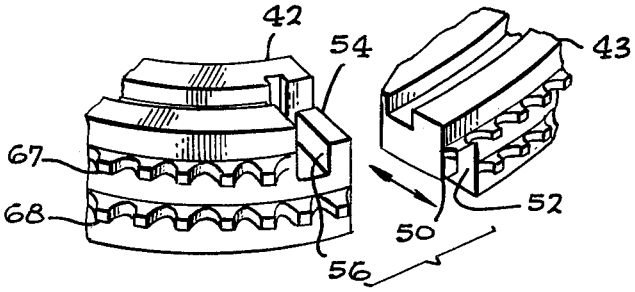
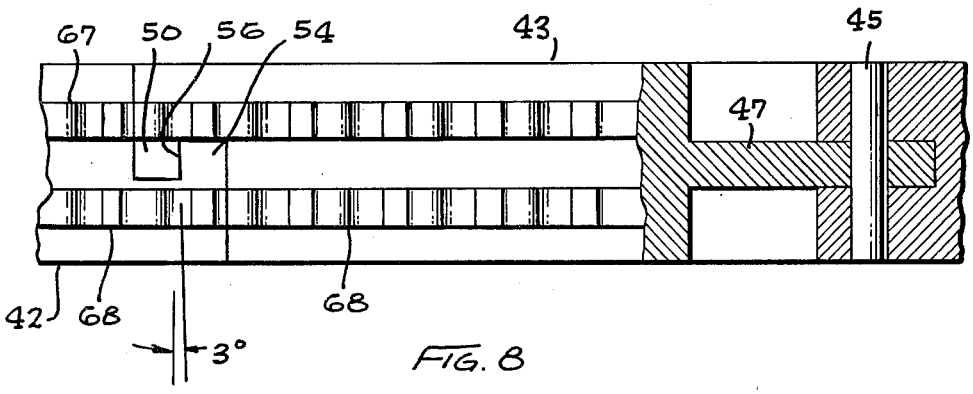
FIG. 8

FIG. 9
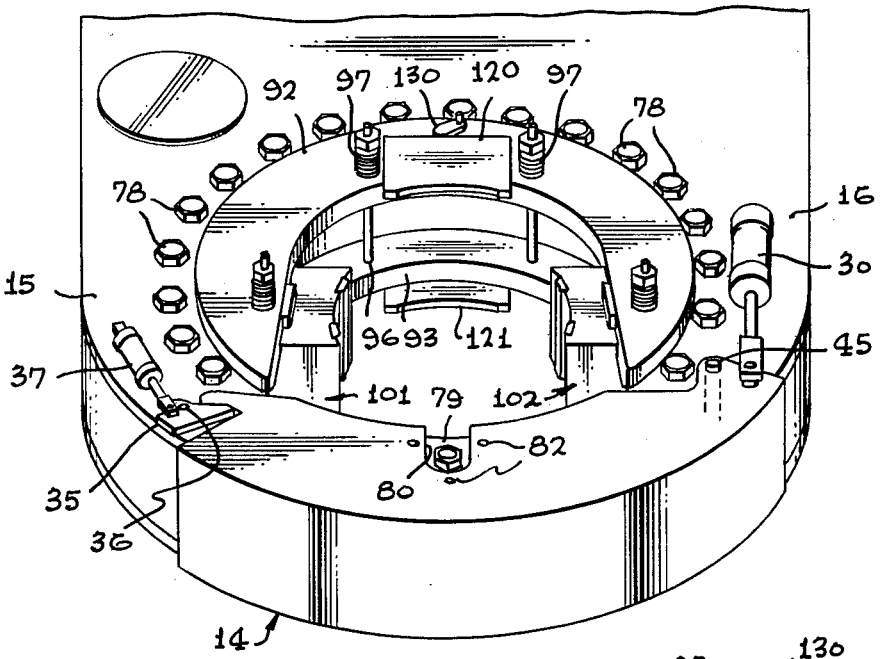
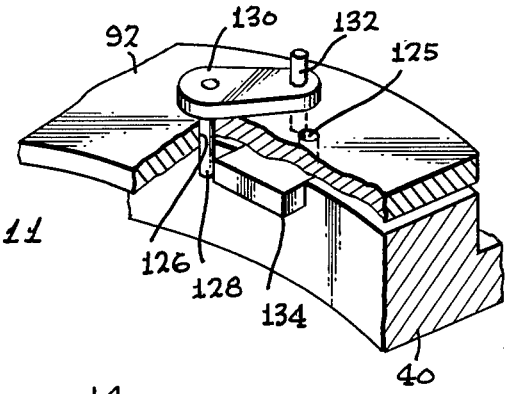
FIG. 11
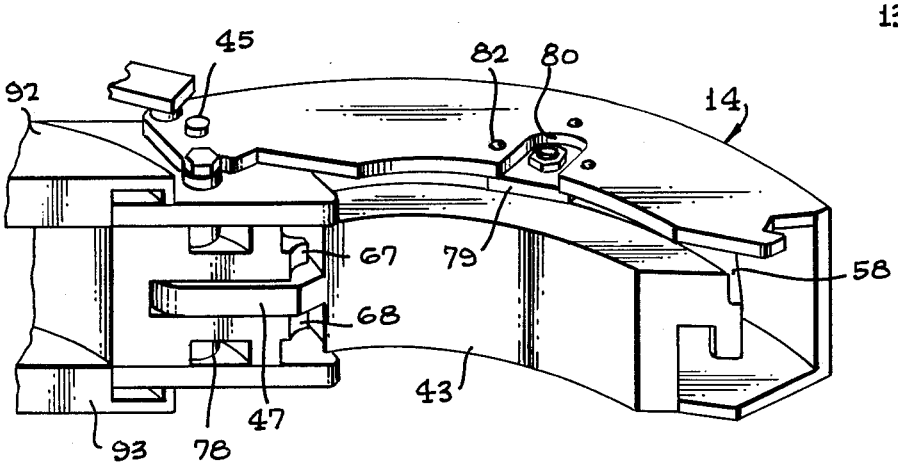
FIG. 10

POWER TONGS

BACKGROUND OF THE INVENTION

Present day power tongs that are employed for coupling and decoupling threaded pipe sections are typically subject to one or more of a number of practical problems. Some examples are found in systems for the engagement and disengagement of sections of a casing or pipe string that is to be lowered into or removed from a well bore. Extremely high torques may have to be applied, due to combinations of factors such as the presence of corrosion, the existence of distortion, and pipe size and weight. High shock forces arise, both in the "make" direction of rotation when a shoulder is suddenly encountered, and in the "break" direction at initial disengagement. Moreover, the forces and pressures involved are at such levels that operation is seldom smooth and uniform. For example, in excess of 50,000 foot-pounds of torque may be exerted, and the power tongs may be required to withstand a spreading force of in excess of 200,000 pounds, while relatively small die elements engage the pipe with extremely high force loadings. Consequently it is common for slippage to occur, for the pipe surfaces to become galled, and sometimes for the pipe to be broken.

There is a profusion of patent art in this field, all of which evidences the extent and variety of the problems that are encountered and the numerous attempts that have been made to overcome such problems. By way of reference, the following patents are illustrative of the state of the art: U.S. Patent Nos. 3,875,826, Dreyfuss et al, Apr. 8, 1975; 2,950,630, J. C. Mason, Aug. 30, 1960; 2,879,680, A. W. Beeman et al, Mar. 31, 1959; 3,147,652, George, Sept. 8, 1964; 3,140,624, George, July 14, 1964; 3,023,651, Wallace, Mar. 6, 1962; 2,846,909, Mason, Aug. 12, 1958; 3,064,413, Mason, Apr. 23, 1963; 2,933,961, Adams, Apr. 26, 1960; 3,691,875, Geczy et al, Sept. 19, 1972; 3,704,639, Foss, Dec. 5, 1972; 2,550,045, De Hetre, Apr. 24, 1951; 3,793,913, Wilms, Feb. 26, 1974; 3,996,320, Brown, Dec. 4, 1973; 3,706,243, Wilms, Dec. 19, 1972; 3,180,186, Catlind, Apr. 27, 1965; 3,722,603, Brown, Mar. 27, 1973; 3,635,105, Dickmann et al, Jan. 18, 1972; 3,371,562, Kelley, Mar. 5, 1968; 3,507,174, Dickmann, Apr. 21, 1970.

In order to react against the spreading forces that are created, some systems of the prior art utilize a full rotary construction. That is, the principal operative element is a closed ring rotary which is strong enough to withstand the spreading forces but which because of its closed ring design can only be installed or removed over the end of a pipe. Other workers in the art, such as evidenced by Dreyfuss et al U.S. Pat. No. 3,875,826, have devised specialized ring configurations in which annular elements open on one side may be rotated relative to each other so as to provide a form of equivalent to a closed-ring system. In this system, the heads carrying the gripping dies that engage the pipe are mounted to slide in the rotary. Problems that arose during testing were such that kept the design from being commercially marketed. In practical systems it was found that the Dreyfuss design was such that unbalanced forces were exerted on the dies and the ring system, causing uneven gripping, and the opening in the ring system caused undue wear in the drive gear system. Because of these and other factors the commercial version of this system encountered substantial operative difficulties and is understood to have been withdrawn from the market.

Another example of power tongs which can be opened for side access to a pipe is provided by Wallace U.S. Pat. No. 3,023,651, in which a number of hinged sections are employed in a massive and heavy structure that is difficult to place in position and operate, and is not amenable to use with different sizes of pipe.

A different approach is evidenced by Eckel U.S. Pat. Nos. 4,084,453 and 4,089,240. In both of these constructions a partial ring having internal cam surfaces is disposed within a gear driving mechanism that substantially surrounds the partial ring. In the former patent the dies that engage the pipe are mounted on pivotable link members, and a critical "cam angle" is defined that must be between ½° and 5½°. This angle is additionally critical because the two dies on a link member are at different radii relative to the pivot axis, and act symmetrically on a given size pipe only within a very small part of their travel. In the latter patent each member, holding the dies provides rectilinear movement, but this is achieved by employing a guide rod sliding within a guide passage in the member. The arrangement is relatively complex and imparts substantial bending moments on the guide rod and the receiving bearings. A drag mechanism forms an essential part of the system, in order to provide relative movement between the partial ring rotary and the die carrier.

The examples of prior art constructions mentioned also are susceptible to one or more of a variety of other problems. For example, fragments and dirt can enter into the cam devices that are typically used to urge the dies into engagement with the pipe, damaging the cams and causing the dies to lock in or out of position.

Many designs also are such that die loading becomes increasingly asymmetrical as pipe size is reduced, substantially increasing die wear and the probability of damage. A power tong should preferably be able to cover a range of pipe sizes without difficulty, and if a further pipe size change is needed it should be effected with only an interchange of parts. Maintenance and life problems have an economic significance far in excess of the cost of the dies or even the pipe involved, because the down time that results when replacements or repair must be made involves not only material costs but also drilling crew costs and the continuing charges for other specialized tool equipment present at the drilling rig. Thus a power tong system which requires frequent replacement of dies or other elements or which causes undue damage to sections in a pipe string would be far inferior to a power tong system which operates steadily and uniformly.

As those skilled in the art are aware, the extremely high stresses and abrupt shocks encountered in operation are usually attended by visible strains on the equipment and by vibrations and sharp impacts which results in a very short fatigue life for the parts involved and the unit as a whole. These are caused by overload or unbalanced force conditions which are further evidenced by undue wear, slippage or equipment damage.

The referenced patents, and the pertinent literature, place substantial emphasis on the use of drag or braking techniques to secure proper biting of the dies relative to the pipe. As the rotary is driven the head or other member supporting the dies is frictionally restrained to insure that the dies do not simply rotate with the rotary. Inasmuch as most power tong systems use approximately 2500 to 3000 psi of hydraulic pressure for driving purposes, and inasmuch as the drag typically requires a pressure of approximately 700 psi, a substantial part of the available energy is effectively used only for overcoming this braking friction. The driving energy available for the power tongs thus is reduced in at least the same proportion. Actually, the total loss in efficiency can be substantially greater, because both the hydraulic system and the prime mover may be operating in less efficient regimes. That is, at higher pressure levels torque may not increase in linear fashion.

The pressure and force levels that are implicit in a high torque power tong system also create significant operative dangers. If the motor is operated without all parts of the system in proper relationship, the resultant forces acting on misaligned parts will almost certainly cause severe damage. If the door housing in a hinged door system is not fully closed, for example, the rotary will warp or bend the door housing even if it is a thick panel of high strength alloy. It must also be considered that not all drilling or casing crews will be experienced, and that in fact mistakes can occur under the most favorable of circumstances. Obviously, many more mistakes can occur in the rigorous, intensive environment of the modern drilling rig, particularly when ancillary problems adversely affect operations. Thus crew members may fail to insure that manual locking systems are secure, or may operate controls in erroneous sequence. Such errors should not be permitted to damage the equipment or create danger to personnel. What is required, in effect, is a fail-safe system that insures both that the power tongs is properly closed and ready for operation, and that there is no response to erroneous operation of motor controls. Preferably these safeguards should be generated within the mechanical-hydraulic system and not depend upon electrical or other interlocks which require a separate power source, involve electrical hazards, or are themselves strongly subject to failure under drilling rig conditions.

SUMMARY OF THE INVENTION

Power tong systems in accordance with the invention incorporate an annular rotary member having a hinged section which may be opened to permit side access to a pipe. The rotary member has an interior cam surface engaged by cam followers mounted on radially movable head plates which slide between side bearing surfaces disposed in substantially rigid upper and lower head plates that are open at one side to permit pipe entry and egress. Peripheral drive of the rotary member radially shifts the facing dies into engagement with the pipe, thereafter rotating the pipe, rotary member and head plate assembly together in the chosen direction. For disengagement the rotary member is driven through a small angle in the opposite direction. With this system, extremely high torques may be exerted with little die wear and with freedom from pipe damage, with only changes in the heads being required to permit operation with different ranges of pipe diameters.

In accordance with other aspects of the invention, the rotary member has an outer toothed portion about its entire periphery and a chain drive, disposed on the opposite side of the rotary member from the hinged portion in its access position, engages the toothed periphery through a limited wrap angle of less than 120°. Upper and lower annular guide grooves in the rotary member receive bearings extending from the associated housing which absorb lateral forces exerted by the chain drive, and constrain the rotary member to rotation about the central axis.

In a more specific example of a system in accordance with the invention, the free end of the hinged section of the rotary includes a curved locking tongue and groove that mate with corresponding surfaces on the opposing end of the rotary. The facing walls in the tongue and groove arrangement follow a circumferential arc segment about the hinge point and are inclined so as to center under stress about the midplane of the rotary. This arrangement both centers and locks the hinged section as spreading forces increase, such that spreading forces exerted at high torque loadings are substantially fully absorbed in the rotary. The hinged portion of the rotary member is itself covered by a hinged door, which can be opened and closed by a hydraulic cylinder, and which in turn controls the position of the rotary hinge. The heads slide radially in bearing slot surfaces in the upper and lower head plates, which are rotatable about the central axis relative to the housing and to the rotary member. The slide bearing surfaces in the structurally rigid head plates restrain the heads against twisting moments, so that there is both minimum wear and uniform head movement. The system is virtually free from contamination by dirt or fragmentary matter, because the wiping action of the bearing blocks on the associated slots tends to keep such matter from coming between bearing surfaces, and the cam followers and cam surfaces are disposed well behind the heads and out of the path of contaminants. The system as tested is found to be self-cleaning instead of self-clogging. Though external drag can be applied to the head plates for special applications, it is found that for the great majority of applications the system smoothly engages and disengages without the application of any external drag whatsoever.

In accordance with other features of the invention, the hinged portion of the rotary member is adjustably coupled to the hinged door to insure that the annular guide surfaces on the hinged portion and the main portion of the rotary member are in alignment when the hinged portion of the rotary is closed. Further in accordance with the invention, both mechanical and hydraulic interlocks are used to assure that damage from erroneous operation does not occur. In this system, the hinged door controls the operative position of the hinged rotary section, which inherently locks with the main rotary under the spreading force exerted by the interior cams. However, the hinged door is itself securely locked by a hydraulically actuated latching mechanism that responds to completion of door closure. A further control assures that hydraulic fluid under pressure bypasses the motor until the latching action has taken place, and when the door is again opened. Consequently the hydraulic motor circuits are disabled unless the hinge mechanism is properly secured for operation.

In a specific example of a mechanical-hydraulic interlock, manually actuator spool valves controlling door actuation, motor drive, and tong vertical movement, respectively, are arranged in circuit with the hydraulic power source, with the motor spool valve position controlling flow direction through the motor. However, a pilot valve that is also in a hydraulic circuit with the motor bypasses the flow about the motor unless necessary conditions are met. The door spool valve, when operated to close the door, actuates a hydraulic cylinder mounted on the main rotary housing that moves the door towards its closed position, carrying with it the hinged rotary section. When a predetermined closure position is reached a cam on the door shifts a two way valve, in turn actuating a hydraulic cylinder controlling a pivotable latch that secures the door closed. Once the latch is at its limit position, pressure buildup at a sequence valve operates the pilot valve when the pressure exceeds a predetermined level. The shift in pilot valve position closes the bypass flow, and permits the hydraulic motor to be driven.

Another feature is the disposition of a chain drive against the rotary member with a limited wrap angle, to provide positive driving of the rotary member while enabling the driving system to be mounted compactly at the base end of the configuration.

To change the system to operate with different sizes of pipe, only the heads need be changed to corresponding sizes. Furthermore, slot and pin arrangements couple the heads to the head plates to limit head movement and prevent unintentional disengagement.

BRIEF DESCRIPTION OF THE DRAWINGS

A better understanding of the invention may be had by reference to the following description, taken in conjunction with the accompanying drawings, in which:

FIG. 6 is a plan view of the rotary member of FIG. 2, showing a hinged portion thereof in open position;

FIG. 7 is a fragmentary perspective view of a portion of the rotary member, showing the interlocking relationship to the base portion of the rotary member;

FIG. 8 is a side fragmentary view, partially in section, of the same portion of the mechanism as shown in FIG. 7, showing further details of the mechanism as seen looking in the direction of the appended arrows;

FIG. 9 is a fragmentary perspective view of the arrangement of FIG. 2, showing further details of the arrangement of the heads and head plates;

FIG. 10 is a perspective view of the hinged portion of the rotary member and the hinged portion of the housing showing a mechanism for adjusting the relative positions thereof;

FIG. 11 is a simplified fragmentary perspective view of a biting pin arrangement for limiting relative motion between the rotary member and head plates in different directions of rotation;

DETAILED DESCRIPTION OF THE INVENTION

A power tong system in accordance with the invention is described in terms of an example of a heavy duty system for high torque (e.g. approximately 50,000 ft.-lb.) applications, such as are encountered with 9" to 12" outer diameter casings used in oil drilling rigs. A system which can satisfactorily handle the high torque problems can obviously be scaled down to a smaller and lighter size, and thus the description confronts one of the most difficult situations to be overcome. However, the system described hereafter can be used with a range of pipe sizes, simply by interchange of head blocks. The lower limit on the size of the pipe which should be handled is actually determined by the mass, bulk and cost of the unit. Inasmuch as power tongs are typically suspended from a lifting system, moved into position about the pipe or casing, and then actuated to thread or unthread adjacent sections, it will generally be preferable to employ a smaller model based upon the same principles when low torques are involved or small diameter pipes are to be manipulated.

Figure 1:
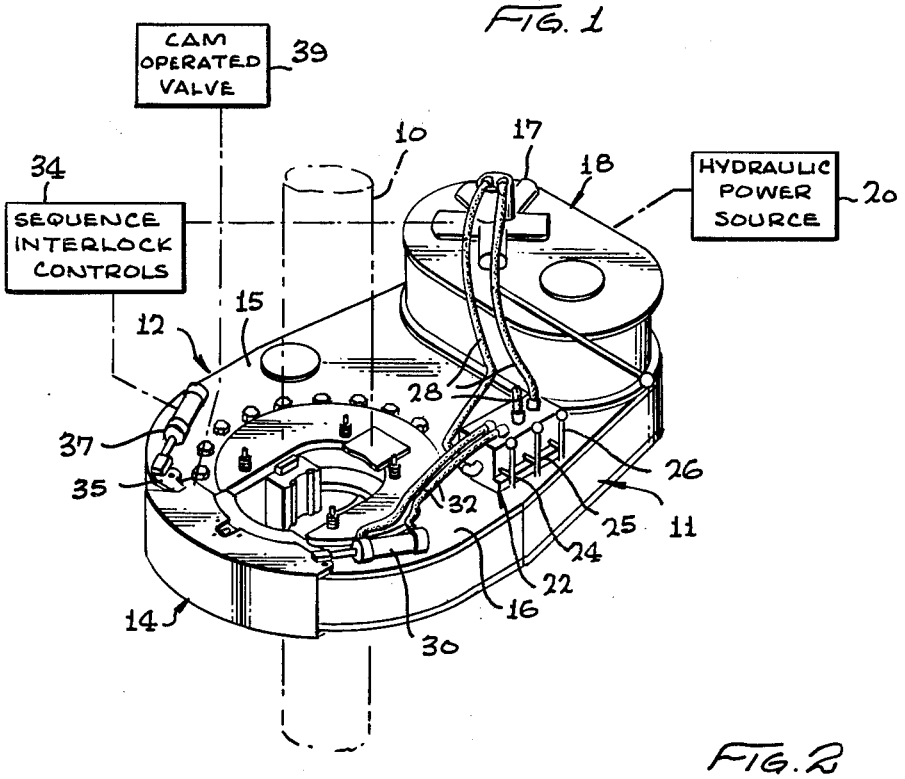
FIG. 1 is a perspective view, partially broken away, of a power tong system in accordance with the invention.
Figure 2:
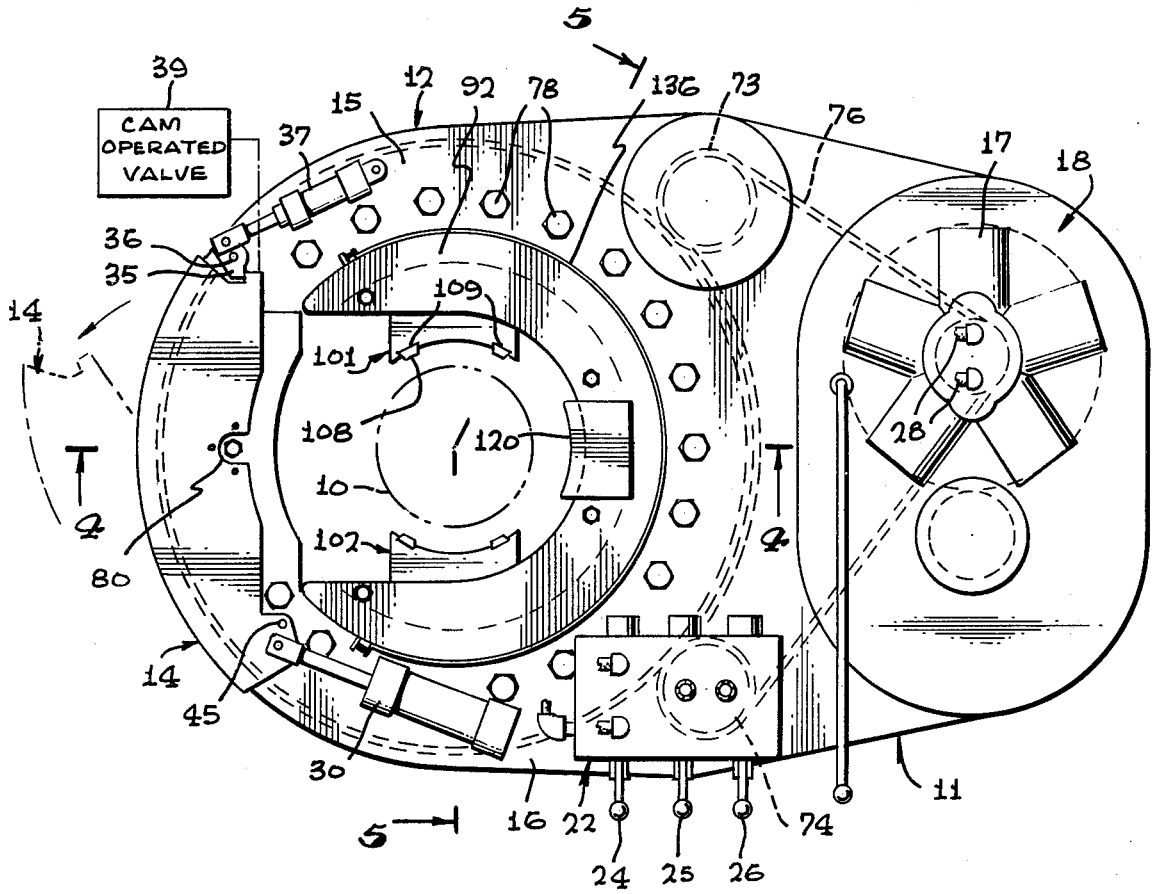
FIG. 2 is a plan view, somewhat simplified, of the system of FIG. 1.

In a system in accordance with the invention, referring now to FIGS. 1 and 2, the power tong is configured to incorporate a generally but not completely enclosed main housing 11 for encompassing a pipe or casing 10 within the base portion of an annular structure 12 that principally encompasses the pipe 10. A completely closed structure is formed by a movable hinge section or door 14 which bridge the curved arm sections 15, 16 when closed, thus defining a circumferential aperture that is larger than the pipe 10 to be received. By pivoting the movable hinge section 14 open the power tongs can gain side access to a pipe 10, after which the hinged section 14 may be closed and the pipe engaged and driven. The central axis nominally occupied by the pipe also corresponds to the central axis of the aperture within the housing 11 and is an operative reference axis for the system. Spaced apart from the reference axis, a hydraulic radial piston motor 17 and associated transmission section 18 are coupled in conventional fashion to a hydraulic power source 20 (shown only generally in FIG. 1). The hydraulic power source 20 generates a suitable high pressure (3000 psi in this example) when driven by a typical prime mover (not shown). A control valve unit 22 mounted on the housing 11 includes control levers 24, 25, 26 positioned on the side of the housing 11 and readily accessible to an operator to control engagement and disengagement of the dies as well as the direction of drive, through hydraulic lines 28 coupled to the motor and transmission section 18. A hydraulic piston 30 mounted on the housing 11 is also coupled to open and close the hinged section 14, under control of the operator via lines 32 connected to the control valve unit 22. For safety and reliability a system of sequence interlock controls 34 (described below in detail relative to FIGS. 13 and 14) may be arranged in conjunction with the control unit 22 and the hinged section 14. A latch member 35 pivotable about a pivot pin 36 on the housing 16 engages a toothed surface adjacent the free end of the hinged section 14 to insure complete closure. The latch member 35 is actuated by a latch cylinder 37 in response to the sensing of the position of the hinged section 14 by a cam-operated valve (not shown in FIGS. 1 and 2), as described below. The sequence interlock controls also assure that the control levers will not operate the motor when the door is open. A cam operated valve 39 (not shown in detail) is mounted on the housing for use in the interlock control system.

Figure 3:
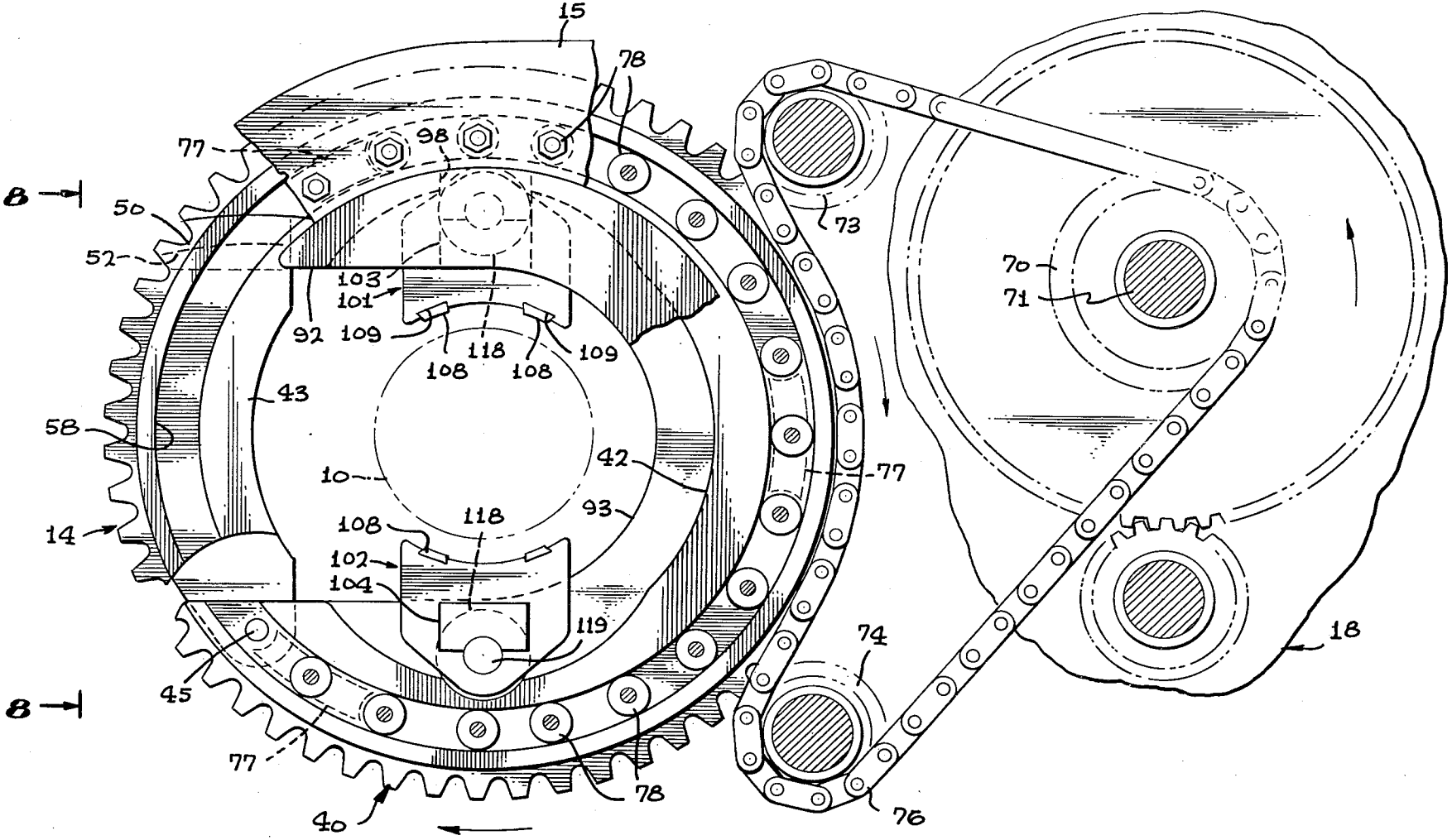
FIG. 3 is a plan view, partially broken away, of the rotary member, head plate and heads in the system of FIG. 1.
Figure 4:
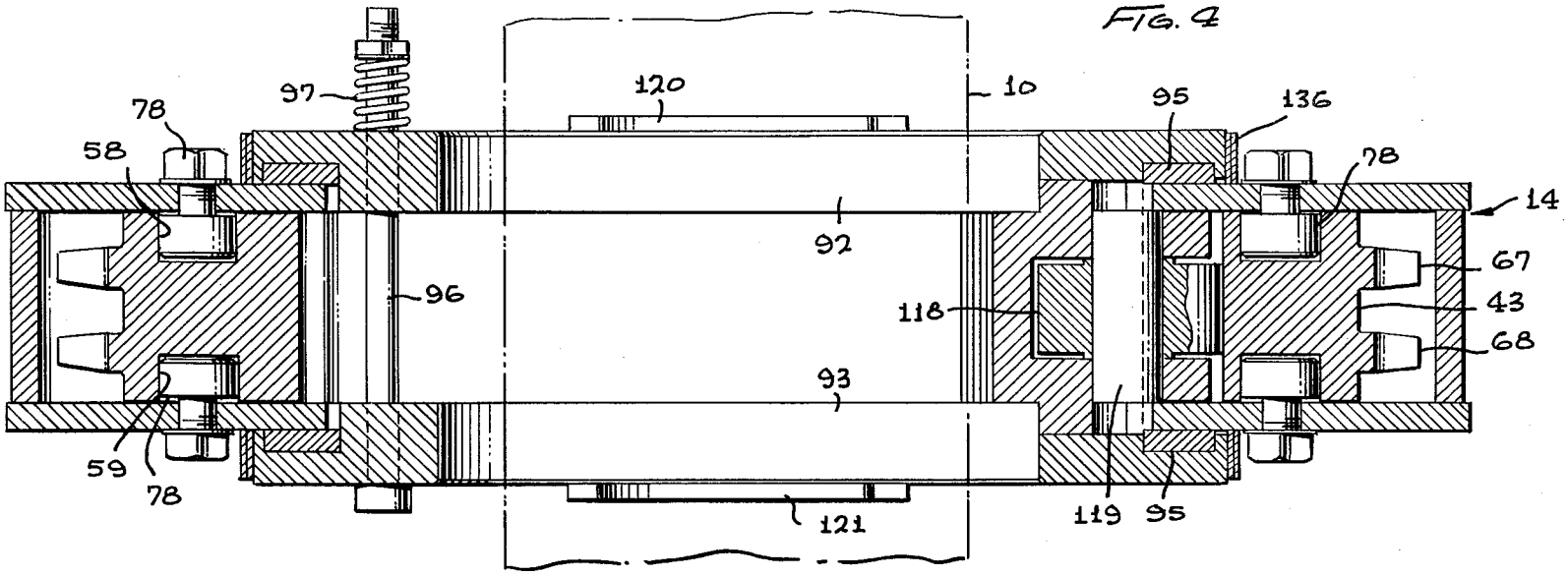
FIG. 4 is a side sectional view, taken along the lines 4—4 in FIG. 2 and looking in the direction of the appended arrows, of the arrangement of FIG. 1.
Figure 5:
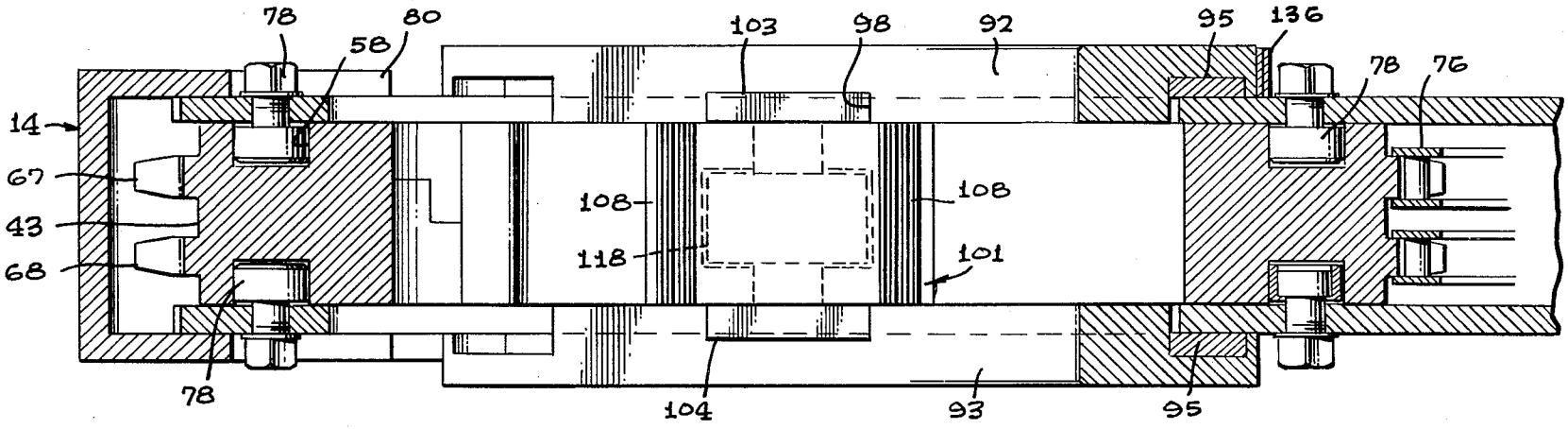
FIG. 5 is a side sectional view, taken along the lines 5—5 in FIG. 2 and looking in the direction of the appended arrows, of the arrangement of FIG. 2.

A number of the principal operating elements interior to the housing are best seen in the plan views of FIGS. 2 and 3 to which reference is now made, although the side views of FIGS. 4 and 5 and the fragmentary views of FIGS. 6–10 will also be referred to in this connection. Central to the physical arrangement and functioning of the power tong system is a rotary member 40, which comprises an approximately C-shaped main section 42 and also includes a hinged section 43 which when closed completes an annulus about the central reference axis. As also seen in FIG. 6, a hinge pin 45 disposed adjacent one end of the main rotary section 42 traverses a terminal groove within which a matching tongue 47 on the hinged section 43 is received, enabling the hinged section to pivot between open and closed positions. At its opposite end, the hinged section 43 has a curved interlocking tongue 50 (best seen in FIG. 7) that is concave in a direction normal to the horizontal plane of the rotary 40, and is centered about the mid-height of the rotary but is only a fraction of the total height of the rotary. Adjacent the interlocking tongue 50 the hinged section 43 includes a groove 52 that is curved about the pivot axis as a center point—the interlocking tongue 50 also defines a circumference about the same point. In complementary fashion, the main rotary section 42 includes an interlocking terminal tongue 54 and adjacent groove 56 which curve about the same point and are in registry with the groove 52 and tongue 50 respectively when the hinged section 43 is in the closed position, as in FIG. 3.

The inner (closest to the adjacent grooves) side walls of the tongues 50, 54 are at a slight angle relative to a circumferential plane about the pivot axis, such that the tip of each tongue 50, 54 is wider than the root. In this example, the angle is approximately 3° to a parallel to the pivot axis. Consequently, a circumferential strain on the rotary 40 exerts a force component along these angled side walls which tends to force the two sections 42, 43 together, resting the tongues in the bottoms of the respective grooves and maintaining the sections 42, 43 centered about the mid-height plane of the rotary 40 (best seen in FIG. 8).

The rotary 40 includes, in both sections 42, 43, annular upper and lower guide grooves 58, 59 (the upper groove 58 appearing most clearly in the plan views of FIGS. 3 and 6 and the lower guide grooves 59 showing in the side views of FIGS. 4 and 5) in its upper and lower faces. These guide grooves 58, 59 are concentric with the central axis and provide substantially complete circular tracks when the hinged section 43 is closed. The inner circumferential surface of the rotary also is substantially continuous between the main and hinged sections 42, 43, and defines a dual symmetrical cam system. As best seen in FIGS. 3 and 6, radially opposed negative (concave) cam lobes 61, 62 in this inner surface provide unload or disengagement positions for associated mechanisms. Adjacent each negative lobe 61 or 62, curved ramp surfaces 64, 65 define arcs of decreasing radii which join with the principal interior circumference of the rotary 40. The outer periphery of the rotary 40 includes upper and lower rows of sprocket teeth 67, 68 respectively (see FIGS. 6–8) for chain drive operation.

The drive system for turning the rotary 40 about the central axis (referring now to FIGS. 2 and 3) operates off a drive sprocket 70 rotating about a drive shaft 71 which is in turn rotated by a speed reducing system (not shown in detail) actuated by the hydraulic motor that provides the motive power for the rotary 40. A pair of idlers 73, 74 are spaced apart, adjacent to the outer periphery of the rotary 40, to define a wrap angle for a double drive chain 76 of limited arc (here less than 90°) about the outer periphery of the rotary 40. Rotation of the drive shaft 71 through the speed reducing system thus rotates the rotary 40 about the central axis in either direction of rotation. Because of the limited angle of wrap of the drive chain 76 on the rotary 40, lateral thrust forces are exerted on the rotary 40, and these are absorbed in load-bearing rollers 78 mounted in the housing 11 at spaced-apart points within and along the upper and lower guide grooves 58, 59. The weight of the rotary 40 is held off the ends of the rollers 78 by aluminum bronze bearing blocks (three in this example) 77 disposed symmetrically about the rotary 40 at the lower plate of the housing only, as seen in the side view of FIG. 4 and the plan view of FIG. 3. The support blocks 77 are held in place by support bolts fitting within central recesses and secured by mating nuts at the outside of the housing. The bearing blocks 77 hold the rotary 40 slightly above the upper ends of the lower bearings 78, so they have no end loading to absorb.

However, only one pair of lateral load-bearing rollers 78 is employed in the arc defined by the movable hinge section 14 of the housing 11. In this region, the single load-bearing roller 78 is mounted in a small support plate 79 which overlaps a cutout portion 80 in the housing for the movable hinge section 14. A number of set screws 82 secure the support plate 79 in the top face of the housing for the moving hinge section 14. Slots (not shown) may be used to permit radial and circumferential adjustment for precise location of the associated load-bearing roller 78 relative to the guide groove in which it rests. The principal function of this roller 78 is not to absorb lateral thrust loads, but instead to permit precise closure of the hinged section 43 of the rotary relative to the main section 42. It will be appreciated that a comparable structure is also used in the underside of the movable hinge section 14. Such adjustable load-bearing roller or rollers can be employed at only one axis along the arc of the hinged section, because the pivot axes of the hinged section 43 of the rotary and the movable hinge section 14 of the housing 11 are different. Thus as the hydraulic piston 30 is actuated to close the hinged section 14 of the housing, the roller 78 pair which carries the hinged rotary section 43 with it must shift in position along the length of the section 43. The relative shifts in position for two such elements relative to the hinged rotary section 43 would be different at different points in time, and the system would bind unless excessive tolerance were introduced, which is not permissible either for precise closure or for continuous operation of the rotary.

A pair of upper and lower head plates 92, 93, slidably mounted on circumferential bearing pads 95 disposed on the inner periphery of the housing 11 about the central opening are coupled by pins 96 and held under controlled compression by springs 97, as best seen in FIG. 5. The spring loading permits adjustment of compression and allows reasonable movement of the head plates 92, 93 under load, and eliminates binding and galling between the heads and head plates. The head plates 92, 93 are generally C-shaped and have open ends which are aligned, in the access position, with the hinged section 14 of the housing and the hinged rotary section 43. High strength materials are selected and adequate thickness and width of material are used for the head plates 92, 93 to insure that there is minimum deflection under load. Each of the head plates 92, 93 includes, as seen in FIGS. 3 and 5 particularly, a pair of radially opposed and spaced apart head slots 98, 99 along the same axis normal to the central reference axis of the system, with the lower head slots 99 in vertical alignment with the upper head slots 98. A pair of heads 101, 102 having upper and lower bearing blocks 103, 104 respectively are configured to mate with a sliding fit in the appropriate upper and lower head slots 98, 99 respectively. By this arrangement the heads 101, 102 are constrained to slide radially relative to the central axis, while moving circumferentially with the head plates 92, 93 as the latter are turned during operation. The bearing blocks 103, 104 provide substantial side bearing surface area for transmitting circumferential forces about the central axis, and torsional or twisting forces acting on the head itself, from the head 101 or 102 to the head plates 92, 93.

Referring to FIGS. 3 and 5 and head 101 specifically, elongated dies or grippers of suitable high hardness material are positioned in the interior face of the head 101, within retainer slots 109. The arrangement at the head 102 is the same and the description need not be repeated. Retainer pins 111 extending through apertures 112 in the head plates engage the heads at slots 113 which prevent full displacement of the heads unless the pins 111 are removed, but do not restrict normal operation.

Cam follower rollers 118 are mounted on the heads 102 on shafts 119, so as to rotate about axes that are parallel to the central reference axis as the cam follower roller 118 engages the interior cam surface of the rotary member 40. In the position shown in FIG. 3, the cam follower rollers 118 are resting within the negative lobes 61, 62. However, during operation the relative displacement does not extend beyond a limited arc defined by the ramp surfaces 64, 65. It will be appreciated that the heads 101, 102 that are shown can be removed and that other heads of different sizes and shapes may be substituted. Each head size can accept a range of pipe sizes, while assuring that the dies 108 or 109 of each pair operate with like forces on the pipe. In accessing to pipe 10, buffer plates 120, 121 coupled to the upper and lower head plates 92, 93 respectively and positioned intermediate the heads 101, 102, prevent damage from impact by the pipe until it is positioned. All sliding surfaces, such as the contact surfaces between the head plates and the bearing pads, and between the heads and the head plates, and between the chains and sprockets, are coated with heavy duty lubricant prior to operation.

With reference particularly to FIG. 11, forward and reverse holes 125 and 126 are provided in the upper head plate 92, and a biting pin 128 mounted on a pivot link 130 is pivotable about a pivot pin 132 mounted in the head plate 92. The biting pin 128 is insertable in either hole 125 or 126, to engage either side of a stop block 134 set into the adjacent face of the rotary 40. With the biting pin 128 in the appropriate position, the drive can be actuated in the forward or reverse direction to couple or decouple pipe. When it is desired to effect an opposite function, however, such as to disengage after engagement, the stop block 134 limits the extent of movement, as will be more apparent from the discussion of the head block operation below.

Although not found necessary in practice, as described below, a brake band 136 can be mounted about a major portion of the periphery of the head plates 92, 93, as seen only in FIGS. 1, 4 and 5. In conventional fashion, the brake band 136, if used, can be tightened or loosened by threaded anchor pins at each end that are adjustable in brackets mounted on the housing 15 (as depicted only generally in FIG. 2).

In operation, the power tong is typically used in the field by being suspended from a crane or a hoist, with chain hooks engaging eyes within brackets (not shown) extending from the housing 11. The movable hinge section or door 14 of the housing is open, also drawing open the hinged section 43 of the rotary 40, as seen in FIGS. 6 and 10 particularly. In this access position for receiving or being withdrawn from a pipe or casing 10, the openings in the head plates 92, 93 are also aligned with the opening in the housing 11, in the position shown in FIGS. 3 and 9. As seen in FIGS. 3 and 6, the cam follower rollers 118 of the heads 101, 102 rest in the concave cam lobes 61, 62 in the rotary 40. Thus the heads 101, 102 are radially displaced away from the central axis, and a pipe 10 may be inserted with its longitudinal axis parallel to the central reference axis of the system, via the side opening thus provided. To describe a complete cycle of operation, it is assumed first that the hinged sections are opened to receive a pipe 10 which is to be decoupled from the uppermost end of a pipe string. At this point in time, the hydraulic system is fully pressurized and the operative controls ready to function.

When the pipe 10 is within the circular aperture defined within the housing 11, the door 14 may be closed without regard to whether the pipe is precisely enough positioned for engagement to occur. Actuation of a control lever 24, 25 or 26 actuates the hydraulic piston 30, causing the door 14 to rotate about its pivot axis, closing its free end against the free end of the opposite curved arm 15. Concurrently, the single guide roller 78 resting in the guide groove in the movable hinge section 43 of the rotary 40, and adjusted to a predetermined position relative to the door 14 of the housing, moves the rotary hinge section 43 about its hinge pin 45 (as best seen in FIG. 10), closing the rotary 40. The arcuate interlocking tongues 50, 54 on the hinge section 43 and the principal section 42 of the rotary register in the grooves 56, 52 respectively in the opposing members. When the rotary hinge 43 is fully closed, as seen in FIG. 3, the interlocking tongues 50, 54 are concentric on a radius about the hinge pin 45. Thus as spreading forces are exerted on the rotary 40, the major force component through the hinged section 43 is on a straight line between the hinge pin 45 and the interlocking tongues 50, 54. The points at which forces are exerted by the cam follower rollers 118 are always somewhere on the principal body of the rotary 40, so that only the force exerted by the spreading tendency of the opposite free ends of the principal section 42 of the rotary 40 must be reacted against by the hinged section 43. When the door 14 is closed, the sequence interlock controls 34 actuate the latch cylinder 37, engaging the latch 35 to the door 14 at its free end.

With the hinged sections suitably secured, and a closed ring structure formed, inadvertent errors in operating the sequence of controls create little likelihood of equipment failure. If the hinged sections are open, however, or if they are not fully closed, then driving of the rotary can damage parts of the equipment. This is found in practice to occur, either because of an attempt to sequence too fast, or because of simple inadvertence. The sequence interlock controls 34 assure that the control valve unit 22 cannot be actuated to rotate the rotary member 40 in either direction unless there is full closure, an aspect which is more fully described hereafter.

Once the rotary hinge 43 and the door 14 are fully closed and secured, power may be applied to the rotary 40 through the chain drive 76. In the "make" direction, the drive chain is driven, as seen in FIG. 3, in the counterclockwise direction, immediately shifting the cam follower rollers 118 out of the concave lobes 61, 62 which they occupy in the access position, and onto the adjacent ramps 65 which urge the heads 101, 102 radially inwardly toward the central axis and with the dies 108 in proximity to the pipe exterior. The initial distance to be traversed is the gap provided in order to have sufficient clearance to enable side accessing of the pipe. After the initial fairly rapid increment of movement, the ramp surfaces 65 (in this example) more slowly drive the heads 101, 102 inwardly, so that the dies 108 engage and then grip the centered pipe 10. If the pipe 10 is not precisely positioned, the symmetrically disposed dies 108 nonetheless force it into position for uniform exertion of radial force by the individual dies as the heads 101, 102 come together. An initial rotation of less than 10° of arc is sufficient to engage and grip the pipe 10, and with the proper heads for a chosen pipe size, the cam follower rollers 118 do not move beyond the limited arc defined by the outer limits of the ramp surfaces.

In most practical applications of power tong devices in accordance with the invention, no brake, drag or frictional restraint need be employed to induce the needed relative motion between the heads 101, 102 and the rotary 40. Even though the head plates 92, 93 in which the heads 101, 102 are mounted rest on bearing pads 95, and the contact surfaces are fully lubricated, so that the frictional restraint on head plate movement is low, the head plates 92, 93 do not turn with the rotary 40. It appears that the system is evenly enough balanced, and frictional restraints on radial movement of the heads 101, 102 are sufficiently low, that the relatively small friction in the head plate system is sufficient to cause the cam follower rollers 118 first to leave the concave lobes and then to ride up on the ramp and initiate engagement between the dies 108 and the pipe. Once such engagement is obtained, of course, high frictional forces are encountered and the reaction force transmitted from the pipe to the rotary 40 as a spreading force is encountered insures locking of the head plate, head and rotary system into a temporarily unitary structure having no relative movement between the parts. Thereafter, for as long as is needed for the pipe sections to be coupled, the chain drive 76 rotates this system until full threading is obtained. A large percentage of the time a pipe shoulder is encountered which impacts the system and causes it to lock.

With the pipe sections having been coupled, the next operation is to disengage the power tong from the pipe 10. A control lever 24, 25 or 26 is actuated to reverse the rotary 40 direction, driving the cam follower rollers 118 back toward the concave lobe 61, 62 positions. Again, no frictional restraint or braking force need be exerted to break free of the pipe. During the initial phase of disengagement, the dies 108 are secured to the pipe 10 surface, and no braking effect would be needed in any event. As soon as the dies 108 are loose relative to the pipe 10, however, it appears that the friction in the head plate bearing system is again adequate, along with centrifugal force, to return the heads 101, 102 to rest in the access position. This freedom from the use of braking or drag effects eliminates the need for what might be called a deadband in the hydraulic pressure range, in which a substantial amount of useful energy (represented by up to 700 psi of hydraulic pressure) must be expended solely for overcoming friction. Under these conditions, as much as 20–25% of the pressure available in a 3000 psi system is effectively wasted. Instead, practically all of the hydraulic pressure range is available for useful work, enabling a given unit to apply more foot-pounds of torque to the working section of pipe than would otherwise be the case. The ability to operate without drag is not merely theoretical, but has been confirmed by substantial testing in the field under operating conditions.

In counterrotating the rotary 40 away from the engagement position (counterclockwise as viewed in FIG. 3), there would of course be a tendency for the cam follower rollers to continue past the concave lobes 61, 62 at the access position, so as to move the heads radially inwardly to again engage the pipe and attempt to decouple it. However, with the biting pin 128 (FIG. 11) in the forward position hole 125, the stop block 134 is immediately engaged as soon as a slightly over-center position is reached. Thus the head plate 92 and rotary 40 assembly again commences to rotate as a unit, but this time free of the pipe 10. For any succeeding accessing operation, the operator need only position the rotary in the access position, with the hinged rotary section 43 in alignment with the hinged door 14 and the housing 11.

To complete the operating sequence, a previously coupled pipe in a pipe string may be decoupled by driving the chain drive 76 in the opposite (clockwise as seen in FIG. 3) direction, so as to drive the heads 101, 102 inwardly on the opposite ramp surfaces 64, engaging the pipe 10 and then rotating it in the counterclockwise direction until fully decoupled. The heads 101, 102 may then be disengaged from the pipe 10, with the biting pin arrangement eliminating any further tendency to recouple, and the rotary 40 returned to the access position. At this point the hydraulic piston 30 may be actuated so as to open the door, permitting removal of the power tong from the side of the pipe.

It should be appreciated by those skilled in the art that, unlike the great majority of existing systems, this power tong in accordance with the invention operates smoothly, with little noise, and with symmetrical gripping of the pipe by the dies. In practice, galling or damage of the pipe are eliminated for all practical purposes, even when maximum torques are applied. A review of the geometrical and force diagrams of FIG. 12 will aid in understanding how this smooth and balanced operation is effected.

When the hinge section of the rotary is closed, and the self-centering interlocking feature is in operation, engagement of the dies on the heads to the pipe introduces a spreading force or circumferential force on the rotary body. The hoop strength and deformation characteristics of the rotary are sufficient to contain this force without distortion. Spreading forces act along a tangent between the pivot P and the arc K of the interlocking groove geometry in which the hinged section is seated, but do not introduce distortion of the hinged section. The thrust absorbing rollers mounted in the housing and seated within the annular guide grooves in the rotary at various points through a substantial angle, have the primary function of reacting against the lateral thrust exerted along the plane of the rotary by the drive chain acting on one side. The hinged section does not essentially disturb the symmetry of the rotary, regardless of its rotational position.

Figure 12:
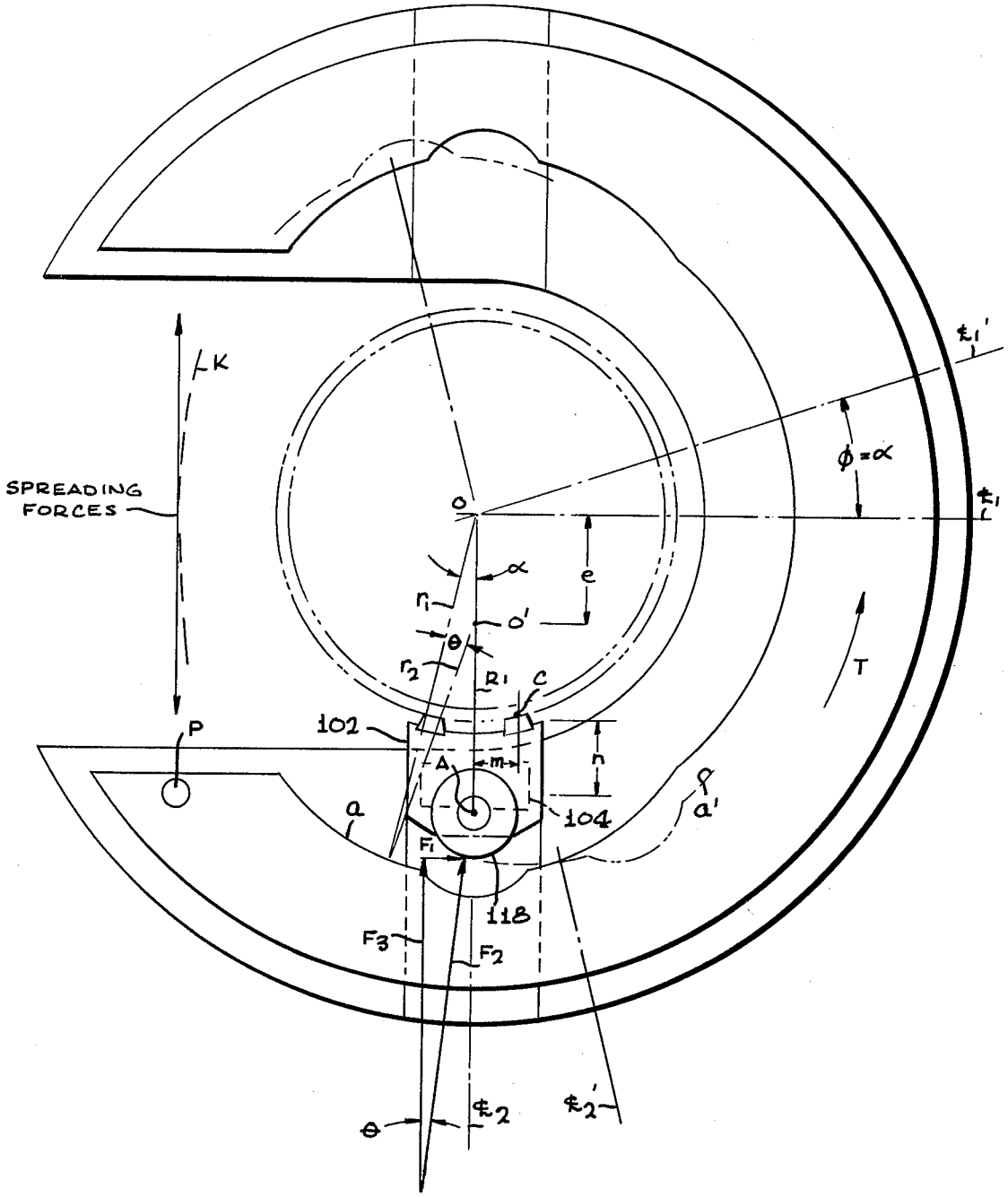
FIG. 12 is a simplified plan view of various operative portions of the system, showing force distributions therein.

When under load, the rotary (regardless of its rotational position) must absorb the radially outward forces directed from the follower rollers through a relatively limited arc on each side of the hinge section. As seen in FIG. 12, the relative movement between the heads and the rotary is confined to a limited arc, designated in FIG. 12 as the angle $\alpha$, and determined by the initial radial spacing of the dies from the exterior of the pipe and the radius of the ramp surfaces. The ramp surfaces (a) lie along an arc that is at a radius $r_2$ from a center 0' that is spaced apart from the central axis O of the system by a distance e. The total angle of possible excursion on either side of center line 2 is only approximately 30°, so that movement of the rotary causes engagement or disengagement within this arc. As noted above, the heads actually wedge into position or become freed somewhere along the intermediate portions of the ramp surfaces (a) adjacent the concave center cam lobe positions. The angle of rotation to cause biting is designated $\phi$, while the included angle between radii $r_1$ and $v_2$ is designated $\theta$, the cam angle. The cam angle $\theta$ is preferably between 6° and 12° in this system. Because the radius $r_2$ is less than the radius $r_1$, there is a slight circumferential force component ($F_1$) acting on the cam follower roller when the cam surface is in the position shown in dotted lines as a' (in the opposite direction when the rotary is shifted in the opposite sense). The force $F_1$ is the force on the roller due to torque T applied to the rotary, so that $F_1=T/r_1$. $F_2$ is the force due to the wedging action of cam angle $\theta$, i.e. $F_2=F_1/\sin\theta$. The reaction forces on the roller are transmitted to the head at point A, on the opposite side of the bearing. The significant question is whether the force $F_1$ acting at the radius n will introduce significant torque about the point C on the die. However, under load the force $F_3$ is always much greater than $F_1$, and the moment $F_3n$ is therefore also substantially greater than the moment $F_1n$. Thus even under load the head plate carries no significant torsional load to cause unequal biting or wedging of the dies. Another factor which contributes to this superior result appears to be adequate structural rigidity under load to minimize distortion. With minimal distortion, stress variations are reduced and wear will be low, and this has been found to be the case in practice. Any torsional forces that exist are reacted against by the side bearing faces engaging the head bearing blocks. These bearing faces are large in area and spaced well apart, and the head plates are sufficiently massive and rigid to provide relatively fixed bearing surfaces. This means in turn that the heads, once the dies are engaged, are not permitted to move other than radially relative to the central axis of the pipe, so that in consequence the four dies (in this example) act substantially uniformly on the pipe. Consequently, force symmetry is maintained despite dimensional variations in the pipe and in the dies themselves, over a substantial range. Further, the high radial forces needed for high torque loading are uniformly distributed and are not excessive at any one die. In prior art systems, lack of an equivalent balance permits one die to dig in more than another, damaging or in some instances destroying the pipe or part of the associated mechanism.

The high torques and forces involved in decoupling or coupling the pipe must of course be overcome by comparable forces at the drive system. With a limited wrap angle of drive chain relative to the outer periphery of the rotary, the lateral force exerted in the plane of the rotary becomes very high. However, this does not cause distortion of the rotary, as the majority of the lateral thrust force is absorbed on the same side that is exerted. The most highly stressed portion of the rotary at any instant is that portion facing the wrap angle of the drive chain, and only in the region between the outer sprocket teeth and the corresponding arc of the guide groove. These are compressive stresses which are localized and readily taken up in a rotary as described herein.

There are as well many other operative advantages to this system. It is a compact unit with a convenient geometry for gaining side access to a pipe by a small crew that requires no more than normal training. The controls are readily accessible and simple enough, together with the interlock features, to prohibit improper use of the tong operative mechanism. Further, the problems that are encountered with most prior art systems as to dirt and debris contamination do not present substantial difficulties in this system. Chips and splinters which might be generated at the contact regions between the die and pipe are well separated from the interior periphery of the rotary, and are not carried back into the rotary structure to tend to wedge between the cam follower rollers and the inner cam surface on the rotary. Furthermore, dirt and particles which do fall on the exposed surfaces of the heads are wiped clean as the heads move radially inwardly and outwardly relative to the central axis, and there is no need for a shielding or protective structure although one could be provided.

Figure 13:
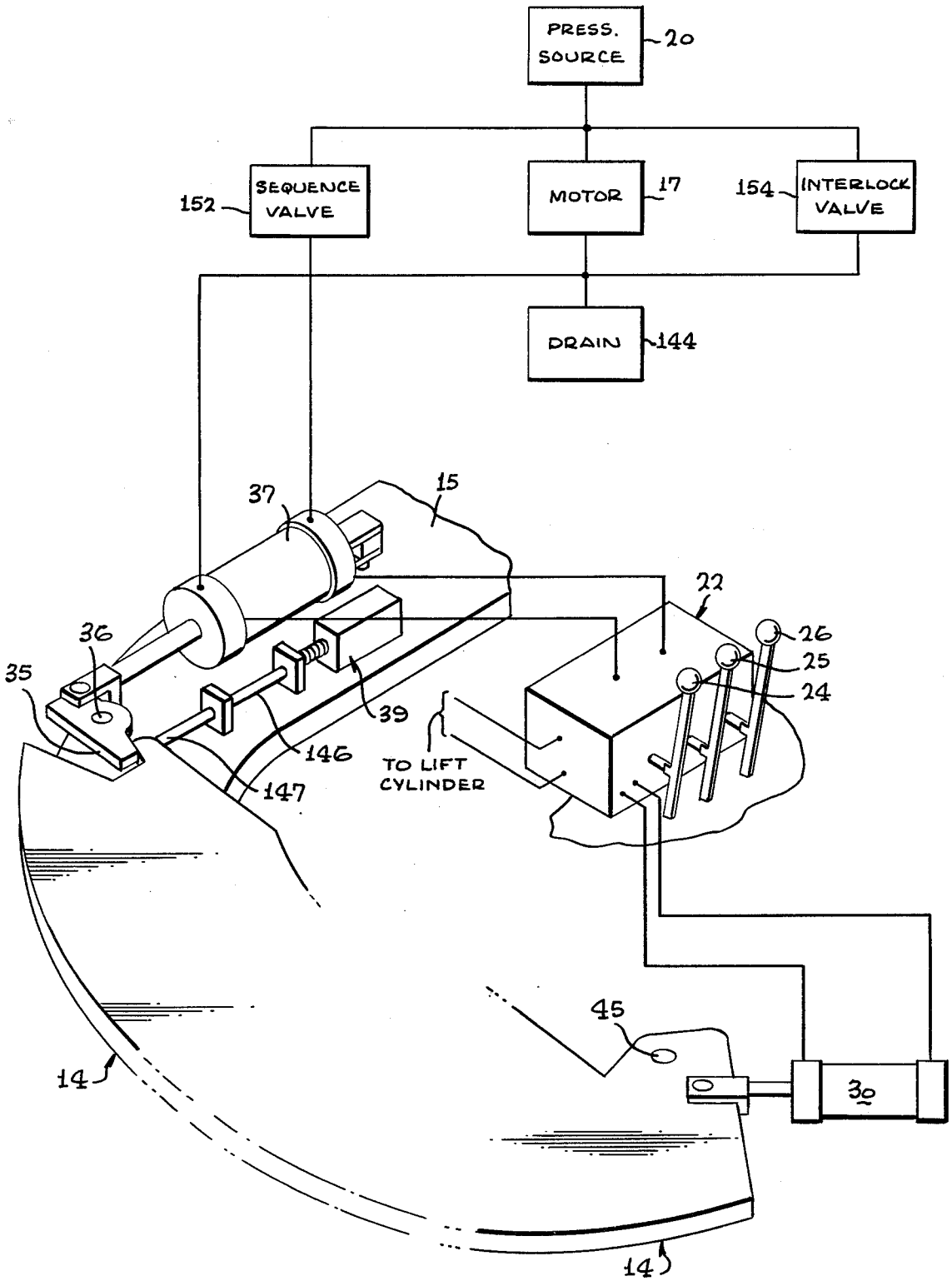
FIG. 13 is a fragmentary perspective view, partially broken away and somewhat idealized, showing details of a mechanical-hydraulic interlock system used in the arrangement of FIG. 1.
Figure 14:
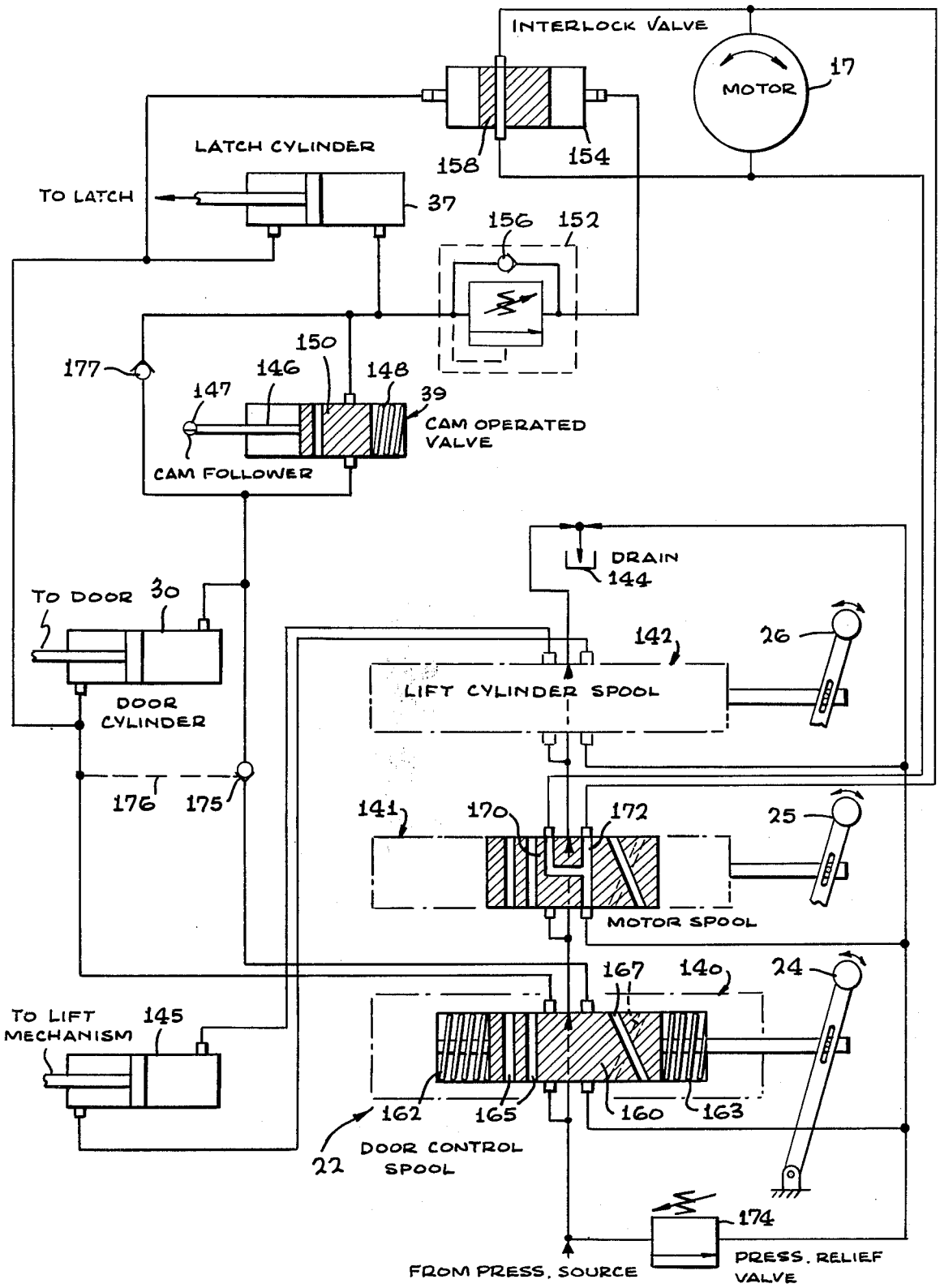
FIG. 14 is a schematic diagram of the arrangement of hydraulic mechanisms and hydraulic circuits used in accordance with the invention.

Details of the principal mechanical and hydraulic devices used in the interlock system may best seen in the fragmentary and somewhat idealized view of FIG. 13, as well as in the schematic view of FIG. 14. Reference must be made to FIG. 14 for the detailed hydraulic interconnections that are employed, because these are not specifically shown in FIG. 13. The principal controls for the operator are the control arms or levers 24, 25, 26 extending from the control valve unit 22, which in this specific example comprises a three-spool stack valve, one spool of which is a door control spool 140, a second of which is a motor control spool 141, and a third of which is the lift cylinder spool 142 that controls vertical movement in the associated system, and which is coupled by conventional means and need not be further described in detail. Pressurized hydraulic fluid from the power source is coupled to each spool 140, 141, 142 and appropriately returned, depending upon valve settings, to a drain. If one of the spools is operated fluid is coupled through the appropriate one of the various controlled mechanisms, including the door cylinder 30, the latch cylinder 37, and the lift cylinder 145, and the direct drain connection is decoupled. Control is also exerted, of course, over the direction of operation of the motor 17.

As best seen in FIG. 13, the cam operated valve 39 is physically mounted on the upper plate of the housing, and includes an axial shaft 146 terminating in a cam follower 147 that is biased in the direction toward the free end of the door 14, specifically to engage a protruding tooth portion which is to be locked by the latch member 35. A spring 148 biases the cam follower in the direction toward the hinge, and a two position valve element 150 (FIG. 14) within the valve 39 provides communication between inlet and outlet ports when the cam follower 147 is forced back by full closure of the door 14. The system also includes a pressure responsive sequence valve 152 and a two position interlock valve 154, shown only generally in FIG. 13, each of which may be placed on the housing of the rotary or adjacent the motor 17, as desired. The sequence valve is pressure adjustable to provide communication of hydraulic fluid from the latch cylinder 37 circuit to the interlock valve when a predetermined pressure level (typically 500–2000 psi in this example) is reached. The sequence valve is shunted by a check valve 156 in conventional fashion. The movable valve element for the interlock valve 154 is actuable to either of two limiting positions, in one of which as shown the valve element provides a conduit between the inlet and outlet ports. The valve element 158 normally occupies the position shown, thus providing a shunt path about the motor 17. When actuated to the opposite position (to the left as seen in FIG. 14), the shunt path is terminated and the motor 17 can be actuated.

The connections between the various elements are not fully depicted in FIG. 13, inasmuch as they are shown more accurately in the schematic diagram of FIG. 14. In FIG. 14, the door control spool 140 and the lift cylinder spool 142 are similar elements, having a normally centered valve member 160 which is biased to be self-centered by a pair of oppositely disposed springs 162, 163. Internal conduits 165 directly intercouple the inlet and outlet ports in one position of the spool 140, whereas conduits 167 provide crossed connections between the inlet and outlet ports on the opposite position of operation. Note that spool or slide valves or other valve configurations may be used, and that the valve spools have been indicated in generalized form for simplicity. The motor spool valve element 170 also provides direct or intercrossed positions between the inlet and outlet ports depending upon whether it is at one limit position or the other. In the centered position, however, the interior conduits 172 couple all ports but one to the drain 144.

The hydraulic interconnections between the various spools 140, 141 and 142 and the various actuated elements will be evident from the following description and need not be traced in detail. In general, however, the source of pressurized fluid is coupled to an input port of each of the three spools 140, 141 and 142, with a pressure relief valve 174 of the adjustable type being in circuit with the drain 144 to limit maximum applied pressure. As shown by dotted lines, this type of commercially available three spool valve couples the pressure source internally through the three spools to the drain until one of the valve spools is shifted. One port of each spool is coupled to the drain 144, and the remaining ports are coupled to the opposite sides of the individual actuating cylinders 30, 37 and 145. The circuit between the lift cylinder spool 142 and the lift cylinder 145 is the simplest, with couplings being made to opposite ends of the cylinder 145 to effect movement in opposite directions. The door cylinder 30, and the latch cylinder 37, are however actuated in an integrated fashion with the interlock valve 154, so as to provide safeguards over motor 17 operation. At the door control spool 140, movement of the valve body 160 to the right (for opening the door) causea a direct coupling of the power source to the left hand side of the door cylinder, moving the door cylinder piston to the right. At the same time, pilot pressure in the line to the left side of the door cylinder 30 opens a pilot check valve 175 via a line 176, coupling the opposite side of the door cylinder 30 (and other elements in the system) to the drain. If the valve body is moved in the opposite direction, the door cylinder piston is actuated to be moved to the left, through the pilot check valve 175. Movement of the door cylinder 30 piston to the left in FIG. 14 represents the direction of movement needed to effect door closure. At the same time as the door closure is being carried out, pressure is applied to the cam-operated valve 39, and also to a bypass check valve 177 which shunts the inlet and outlet ports of the cam operated valve 39, but the pressure is applied in the direction such that the check valve 177 does not open. The physical shifting of the door to the closed position acts upon the cam follower 147, and when sufficient movement has taken place to shift the valve body 150 to its right hand position as seen in FIG. 14, then the pressure source is in circuit with the right hand inlet port of the latch cylinder 37, moving the interior piston to the left, which is the direction required to close the latch so as to fully secure the door. Conversely, actuation of the door cylinder 30 so that the piston moves to the right also provides pressurized fluid at the left hand input port to the latch cylinder 37, thus opening the latch to free the door. This opening movement concurrently moves the interlock valve 140 to its normal shunting position, described in greater detail hereafter. Thus closure of the door by full actuation of the piston of the door cylinder 30 to the left is accompanied by the latching action initiated by the latch cylinder, and the circuit tends to remain in this operating condition as pressure builds up in the inlet side of the latch cylinder 37. Sufficient pressure buildup causes opening of the pressure responsive sequence valve 152, transferring inlet pressure to the right hand side (as seen in FIG. 14) of the interlock valve, moving the interior valve body 158 to its left hand position, and closing the shunt circuit about the motor.

In this operating status, the interlock control system now permits the motor spool 141 to be actuated in an appropriate direction, as desired by the operator. If the valve body 170 is moved to the right, pressurized fluid is passed through the motor 17 in one direction, giving a specific direction, while the conditions and the direction of operation are reversed for the other non-centered position of the motor spool 141.

This arrangement prevents the motor from running if the door is not fully shut and securely locked. The cam operated valve 39 is arranged to be responsive to the last 5/16" travel of the door in this example, and not only positive closure of the door but also full actuation of the latch are required to shift the interlock valve 154 to the position in which the motor is enabled. When the shunt path through the interlock valve 154 is in existence, only 50–80 psi of pressure is in the system, this being the pressure loss in the fluid diverted to the drain, and even if there were erroneous actuation of the motor controls there would be only a slight creeping of the rotary and such motion terminates at the first resistance that is encountered. If an attempt is made to open the door, the direct connection between the inlet and outlet ports of the door control spool 140 also couples to the left hand inlet port of the interlock valve 154, reestablishing the shunt path for fluid about the motor 17. If the door cylinder 30 is to open the door, and the cam operated valve 39 has not sufficiently shifted in position prior to movement of the piston in the latch cylinder 37, then back pressure in the right hand side of the latch cylinder 37 causes opening of the check valve 177, which functions to provide a return path and permit release of the latch.

Although there have been described above and illustrated in the drawings various forms and modifications in accordance with the invention, it will be appreciated that the invention is not limited thereto but encompasses all variations within the scope of the appended claims.

What is claimed is:

1. A power tong for rotating cylindrical elements comprising:

upper and lower head plates having aligned side openings for receiving a cylindrical element to be rotated;

a rotary member disposed between the head plates and movable relative thereto about a central axis, and having an inner periphery defining a cam surface, a toothed outer periphery and a hinged section for opening to receive a cylindrical element to be rotated, the rotary member forming a complete loop when the hinged section is closed;

means including cover means coupled to the hinged section of said rotary member for controlling the hinge position thereof;

at least a pair of symmetrically disposed head means disposed between said head plates and radially movable therebetween in response to the position of the cam surface of said rotary member; and chain drive means engaging the toothed periphery of said rotary member for providing rotary motion thereof relative to the central axis.

2. The invention as set forth in claim 1 above, wherein said head plates have bearing slots therein and said head means include bearing blocks registering in sliding engagement within the bearing slots.

3. The invention as set forth in claim 2 above, wherein said head plates are generally C-shaped and disposed to partially encompass the central axis, and wherein said system further includes means including compression spring means for urging said head plates toward the opposite sides of said rotary member with selectable pressure.

4. The invention as set forth in claim 3 above, including in addition sliding bearing means disposed between said rotary member and the lower head plate.

5. The invention as set forth in claim 1 above, wherein the free end of the hinged section and the proximate end of the principal section of the rotary member have interlocking surfaces reacting against spreading forces acting on the rotary member.

6. The invention as set forth in claim 5 above, wherein said hinged section is coupled to pivot about a pivot axis relative to the principal section of said rotary member, wherein said interlocking surfaces lie along circumferential arc segments relative to the pivot axis and define mating tongues and grooves, and wherein said interlocking surfaces include abutting circumferential arc surfaces that are inclined relative to a right circular cylinder lying about the pivot axis, such that the tongues have a greater radial length relative to the pivot axis at their tips than at their roots, such that spreading forces tend to seat the hinged section more firmly in position relative to the principal section.

7. The invention as set forth in claim 6 above, wherein the angle of inclination of the sides of the tongues is at approximately 3° to a line parallel to the pivot axis.

8. The invention as set forth in claim 1 above, wherein said power tong further comprises housing means disposed about said rotary member, and means coupled to said housing means and in engagement with said rotary member for guiding rotation of said rotary member about the central axis.

9. The invention as set forth in claim 8 above, wherein said housing means is disposed in fixed relation to the central axis, wherein said rotary member includes annular guide groove means, and wherein bearing means disposed in said housing means engage said annular guide groove means to guide rotation thereof about the central axis.

10. The invention as set forth in claim 8 above, wherein said chain drive means engages less than 120° of the periphery of said rotary member and said means for guiding said rotary member comprises a plurality of spaced apart rotating bearing means for absorbing side loading forces exerted against said rotary member by said chain drive means.

11. The invention as set forth in claim 8 above, wherein said housing means includes a hinged door portion partially encompassing the hinged section of said rotary member, and said means for controlling the position of the hinged section comprises means for pivoting the hinged door portion and means coupling the hinged door portion to the hinged section.

12. The invention as set forth in claim 11 above, wherein said coupling means comprises bearing member means adjustably mounted in the hinged door portion relative to the central axis and engaging the annular guide groove means in said rotary member.

13. A power tong system for rotatably engaging and disengaging pipe comprising:

a rotary member having an interior opening for encompassing a pipe disposed along a central axis, and including annular guide groove means about the central axis, an interior cam surface and an outer toothed drive periphery, a portion of said rotary member being hinged about a pivot axis and interlocking at its free end with the principal portion of the rotary member;

head plate means disposed adjacent the rotary member and rotatable relative thereto;

head means slidably mounted in said head plate means in a radial direction relative to the central axis, the head means including cam follower means engaging the cam surface of said rotary member;

housing means encompassing at least a portion of said rotary means and including bearing means engaging the annular guide groove means for confining said rotary member in a concentric path about the central axis, said housing means including cover hinge means engaging the hinged portion of the rotary member when in a pipe access position; and drive means engaging a portion of the outer periphery of said rotary member.

14. The invention as set forth in claim 13 above, wherein said head plate means comprise upper and lower head plates, one on each side of the rotary member, each of said head plates including head slots radially disposed relative to the rotary member, and said head means including bearing blocks slidably mating in said heat slots.

15. The invention as set forth in claim 14 above, wherein said annular guide groove means comprise annular grooves in the upper and lower surfaces of said rotary member, and wherein in addition said housing means includes bearing means engaging said annular grooves and confining said rotary member to rotation about the central axis.

16. The invention as set forth in claim 15 above, wherein the hinged portions of said rotary member and said housing means are substantially coextensive when the rotary member is in an access position, wherein the head plate means has an open side in substantial alignment with the hinged sections when in the access position, and including in addition means for controlling the hinge position of the hinged sections.

17. A power tong system for gripping and rotating a cylindrical element comprising:

a pair of spaced apart upper and lower head plates including oppositely facing guide slots disposed along a selected axis, the guide slots defining spaced apart and parallel side bearing surfaces;

a rotary member disposed between the head plates and movable relative thereto, the rotary member including an internal cam surface and outer sprocket;

a pair of opposed heads between the head plates, each slidable in a facing pair of the guide slots along the selected axis, and each including a pair of spaced apart die means for engaging an interior cylindrical element and cam follower means for engaging the internal cam surface of the rotary member; and chain means engaging the outer sprocket teeth of the rotary member and rotating the rotary member, whereby the cam follower means shifts the position of the heads radially relative to engage each pair of die means symmetrically relative to the cylindrical element and lock the head plates to the rotary member, the side bearing surfaces in the guide slots resisting torsional moments acting on the heads under load.

18. The invention as set forth in claim 17 above, wherein the internal cam surface includes a pair of oppositely disposed concave cam nodes, each having adjacent cam ramp surfaces, such that the die means are spaced apart from the cylindrical element when the cam followers are aligned with the cam nodes.

19. The invention as set forth in claim 18 above, wherein said rotary member comprises a principal portion and and a hinged portion, wherein said head plates are generally C-shaped, and wherein said system further comprises means for pivoting said hinged portion relative to the principal portion, whereby the system can provide side access to a pipe.

20. In a power tong system in which a rotary member is peripherally driven, the combination comprising:

a rotary member defining a full ring and having a peripheral drive teeth thereabout;

a drive mechanism disposed coplanar with the rotary member and at one side thereof, said drive mechanism including a drive chain engaging the peripheral teeth through a wrap angle of less than 120° about the periphery of the rotary member;

housing means disposed to encompass at least a portion of said rotary member; and bearing means coupled to said housing and engaging said rotary member other than at the periphery to provide reaction forces against said drive chain.

21. The invention as set forth in claim 20 above, wherein said rotary member is disposed about a central axis and has upper and lower annular guide grooves concentric with the central axis, and wherein said bearing means comprise a series of spaced apart roller bearing means extending into said annular guide grooves on each side of said rotary member.

22. The invention as set forth in claim 21 above, wherein said rotary member has a principal section and a hinged section which may be opened in an access position, and wherein said housing means includes hinged cover means substantially coextensive with the hinged section of said rotary member, a single pair of upper and lower roller bearing means coupling the hinged cover means to the hinged section of the rotary member.

23. In a hydraulic power tong system, the combination comprising:

a pair of spaced apart head plate means rotatable about a central axis and including radially movable head means; and rotary means, including a hinged section closable to form a complete loop, disposed between said head plate means, said rotary means including interior cam means engaging said head means, and interlocking means coupling the free end of the hinged section to the remainder of the rotary means when in the closed position.

24. The invention as set forth in claim 23 above, including in addition housing means having upper and lower plates, and wherein said rotary means includes annular guide grooves on the upper and lower surfaces thereof, and said system further comprises bearing means mounted along said upper and lower plates of said housing, in registry with the associated guide grooves in said rotary member.

25. The invention as set forth in claim 24 above, wherein said system further comprises load bearing means mounted in said lower plate and extending into registry with the lower guide groove in said rotary member, said load bearing means supporting the weight of said rotary member such that said bearing means encounter substantially only side loads.

26. The invention as set forth in claim 25 above, wherein said system further comprises means, including compression spring means, urging said head plate means toward each other.

27. The invention as set forth in claim 26 above, including drive means engaging a limited arc of the outer periphery of said rotary member, and exerting a substantial side loading force thereon.

28. The invention as set forth in claim 27 above, wherein said bearing means comprise a plurality of roller members mounted in said housing means and spaced apart along the annular guide grooves.

29. A power tong system for side access to a pipe, comprising:

a rotary member having a hinged section which when open at an access position permits side access to a pipe;

housing means at least substantially encompassing said rotary member, and including a hinged door section at the side access position, said door section being coupled to the hinged section of the rotary when at the access position;

hydraulic motor means coupled to said housing means;

door cylinder means mounted on said housing and coupled to said door section for opening and closing the same; and interlock means responsive to the position of said hinged cover and coupled to the hydraulic power circuit for said hydraulic motor means for preventing operation of said hydraulic motor means when the door section is open.

30. The invention as set forth in claim 29 above, wherein said system further includes hydraulically powered latching means which when engaged latches the door section in the fully closed position, in response to the position of said door section.

31. The invention as set forth in claim 30 above, including in addition means responsive to the actuation of said latching means for enabling operation of said hydraulic motor means.

32. The invention as set forth in claim 31 above, wherein said system comprises valve means coupled to control said motor, and wherein the hydraulic system includes drain means, and said interlock means includes means for coupling said valve means to said drain means to bypass the motor means.

33. A power tong system having a hydraulic drive actuating a rotary member for driving a pipe or casing and comprising:

means, including a portion of the rotary member, defining a hinged section which can be moved from a closed to an open position for side access to a pipe;

hydraulic means coupled to the hinged section for controlling the movement thereof between open and closed positions; and hydraulic circuit means responsive to the physical position of the hinged section for disabling the hydraulic drive when the hinged section is not fully closed.

34. The invention as set forth in claim 33 above, including in addition latch means responsive to the closed position of the hinged section for positively locking the hinged section in closed position.

35. The invention as set forth in claim 34 above, wherein said latch means comprises cam means coupled to and movable with said hinged section, a pivotable latch element disposed adjacent the free end of the hinged section and engageable therewith, latch cylinder means coupled to control the pivot position of the latch element, and valve means responsive to the position of the cam means for operating the latch cylinder means.

36. The invention as set forth in claim 34 above, wherein said hydraulic circuit means includes interlock valve means providing a selectable shunt path around the hydraulic drive, and means responsive to actuation of said latch means for controlling the interlock valve means to terminate the shunt path whereby the hydraulic drive may be operated.

37. The invention as set forth in claim 36 above, wherein said hydraulic circuit means further comprises latch cylinder means for actuating said latch means and pressure responsive sequence valve means coupled to said latch cylinder means and responsive to the pressure therein for controlling the interlock valve means.

38. A system for securing the hinged section of a power tong having a rotary with a hinged section, and a hydraulic motor drive, and for insuring against operation of the drive with the hinged section not fully closed, comprising:

interlock valve means coupled to the motor drive and normally providing a shunt path to drain for pressurized hydraulic fluid;

means, including control valve means, for operating the hinged section of the power tongs;

latch means, including latch cylinder means, responsive to the position of the hinged section, for securing the free end of the hinged section against opening; and sequence valve means responsive to the buildup of pressure at said latch cylinder means for operating said interlock valve means to terminate the shunt path.

39. The invention as set forth in claim 38 above, wherein said system includes a hinged door section controlling the position of the hinged rotary portion and said latch means includes a cam operated valve having a cam engaging the hinged door section when in the closed position, and wherein the cam operated valve is coupled to control said latch cylinder means in response to door closure.

40. The invention as set forth in claim 39 above, further including hinge control cylinder means coupled to the hinged section of the rotary and the control valve means, and further including check valve means in circuit with the latch cylinder means, the hinge control cylinder means and the interlock valve means for hydraulically locking the same.

41. In a hydraulically operated power tong system having a hinged door, a main rotary assembly, a source of pressurized hydraulic fluid and a hydraulic motor for driving the rotary, the combination comprising:

first manually actuable valve means in circuit with the motor and coupling the pressurized fluid source to the motor to rotate the motor in a selected direction;

interlock valve means coupled to bypass hydraulic fluid around the motor, the interlock valve means normally being in the bypass mode but being shiftable to a power coupling mode;

hydraulic cylinder means coupled to the hinged door and main rotary assembly for controlling the operative position of the hinged door;

second manually actuable valve selectively coupling the pressurized fluid source to the hydraulic cylinder means; and locking control means responsive to a terminal locking position of the hinged door for actuating the interlock valve means to shift said interlock valve means to the power coupling mode.

42. The invention as set forth in claim 41 above, wherein said system further includes locking means coupled to the main rotary assembly for latching the hinged door closed, and said locking control means comprises latch cylinder means coupled to control the locking means, and latching valve means responsive to the terminal position of the hinged door and coupled to actuate said latch cylinder means.

43. The invention as set forth in claim 42 above, wherein said locking control means further comprises pressure responsive valve means in circuit with said latching valve means and coupled to shift said interlock valve means to the power coupling mode when the latching pressure exceeds a predetermined amount.

44. A power tong system comprising:

a main rotary and a hinged rotary section coupled to the main rotary, the main rotary and hinged rotary section having mating terminal portions;

means, including hydraulic motor means and pressurized source means, for driving the rotary at the periphery thereof;

main housing means substantially encompassing the main rotary when the main rotary is in an index position;

hinged door means coupled to said main housing means and coupled to control the hinge portion thereof; and control means, including valve means, responsive to the position of said hinged door means and in circuit with the hydraulic motor means for bypassing said pressurized source means about said motor means unless the hinged door means is in proper position.

45. The invention as set forth in claim 44 above, including actuable door latching means coupling said hinged door means to said main housing means in a locked operative position, and hydraulic means responsive to the position of said hinged door means for actuating said door latching means.

46. The invention as set forth in claim 45 above, wherein said control means includes pressure responsive sequence valve means coupled to said hydraulic means and interlock valve means coupled to bypass said motor means and responsive to said sequence valve means, for terminating bypass flow about said motor means when the hydraulic pressure in said hydraulic means is in excess of a predetermined level.

* * * * *